US005737674A

United States Patent [19]

Venkatesan et al.

[11] Patent Number: 5,737,674

[45] Date of Patent: Apr. 7, 1998

[54] VAPOR CONTROL SYSTEM FOR AND A LIQUID ELECTROGRAPHIC SYSTEM

[75] Inventors: Jai Venkatesan, Woodbury, Minn.; James A. Baker, Hudson, Wis.; Therese M. Downey, Woodbury, Minn.; Russell A. Roiko, Rogers, Minn.; Kay F. Schilli, St. Paul, Minn.

[73] Assignee: Minnesota Mining and Manufacturing Company, St. Paul, Minn.

[21] Appl. No.: 561,080

[22] Filed: Nov. 20, 1995

[51] Int. Cl.[6] ..... G03G 15/10

[52] U.S. Cl. ..... 399/250

[58] Field of Search ..... 355/215, 256; 118/659, 660; 430/117–119; 261/123; 399/250, 251

[56] References Cited

U.S. PATENT DOCUMENTS

| | | | |
|---|---|---|---|
| 2,944,404 | 7/1960 | Fritts | 62/3 |
| 3,162,104 | 12/1964 | Medley | 95/1.7 |
| 3,429,676 | 2/1969 | Gatza | 261/123 |
| 3,608,280 | 9/1971 | Martin | 261/123 |
| 3,620,800 | 11/1971 | Tamai | 117/37 LE |
| 3,635,555 | 1/1972 | Kurahashi et al. . | |
| 3,767,300 | 10/1973 | Brown et al. . | |
| 3,854,224 | 12/1974 | Yamaji et al. | 34/77 |
| 3,880,515 | 4/1975 | Tanaka et al. . | |
| 3,890,721 | 6/1975 | Katayama et al. | 34/73 |
| 3,967,549 | 7/1976 | Thompson et al. | 101/1 |
| 3,997,977 | 12/1976 | Katayama et al. | 34/73 |
| 4,122,473 | 10/1978 | Ernohazy et al. | 354/299 |
| 4,166,728 | 9/1979 | Degenhardt et al. | 55/51 |
| 4,252,546 | 2/1981 | Krugmann | 55/82 |
| 4,415,533 | 11/1983 | Kurotori et al. | 422/4 |
| 4,462,675 | 7/1984 | Moraw et al. . | |
| 4,487,616 | 12/1984 | Grossman | 55/85 |
| 4,503,625 | 3/1985 | Manzer | 34/78 |
| 4,538,899 | 9/1985 | Landa et al. . | |
| 4,593,480 | 6/1986 | Mair et al. | 34/78 |
| 4,687,319 | 8/1987 | Mishra . | |
| 4,727,385 | 2/1988 | Nishikawa et al. . | |
| 4,731,635 | 3/1988 | Szlucha et al. . | |
| 4,731,636 | 3/1988 | Howe et al. . | |
| 4,733,272 | 3/1988 | Howe et al. . | |
| 4,745,432 | 5/1988 | Langdon . | |
| 4,760,423 | 7/1988 | Holtje et al. . | |
| 4,766,462 | 8/1988 | Dyer et al. . | |
| 4,834,477 | 5/1989 | Tomita et al. | 350/6.2 |
| 4,850,117 | 7/1989 | Venkat et al. | 34/32 |
| 4,910,108 | 3/1990 | Tavernier et al. | 430/32 |
| 5,027,145 | 6/1991 | Samuels | 354/299 |
| 5,029,311 | 7/1991 | Brandkamp et al. | 355/30 |
| 5,067,404 | 11/1991 | Frunder et al. | 101/488 |
| 5,073,796 | 12/1991 | Suzuki et al. | 355/215 |
| 5,229,842 | 7/1993 | Dolan et al. | 356/429 |

FOREIGN PATENT DOCUMENTS

| | | | |
|---|---|---|---|
| 55-009508 | 1/1980 | Japan . | |
| 07219263 | 8/1995 | Japan . | |
| 1 451 730 | 6/1976 | United Kingdom | B01D 5/00 |

*Primary Examiner*—Robert Beatty
*Attorney, Agent, or Firm*—William D. Bauer

[57] ABSTRACT

A vapor control system and an electrophotographic system having a vapor control system for reducing vapor emissions. A vapor collection mechanism collects at least some of the vaporized carrier which is then transmitted to a container having a vapor inlet and a vapor outlet containing a cooling liquid, the cooling liquid having a temperature less than the temperature of the vaporized carrier but greater than zero degrees Centigrade. A vapor inlet located at a point below the surface of the cooling liquid results in the vaporized liquid bubbling through the cooling liquid and being condensed therein. The cooling liquid is immiscible with water and, preferably is the carrier liquid. Mechanical resistance devices promote increased bubble residence time and smaller bubble size.

31 Claims, 6 Drawing Sheets

VAPOR CONTROL SYSTEM FOR AND A LIQUID ELECTROGRAPHIC SYSTEM

TECHNICAL FIELD

The present invention relates generally to electrographic systems and vapor control systems for reducing vapor emissions in liquid electrographic processes and, more particularly, to electrophotographic systems and vapor control systems which utilize a liquid condenser.

BACKGROUND OF THE INVENTION

Electrographic systems based upon a liquid carrier produce significant quantities of vaporized carrier during the electrographic process, most notably during processes to dry the formed image. Emission of these vapors from such electrographic systems are a potential source of air pollution and are regulated by governmental authorities.

Several attempts have been made to limit the quantity of such emissions and to recover condensed vaporized carrier for reuse in the electrographic system.

U.S. Pat. No. 4,731,636, Howe et al, Liquid Carrier Recovery System, describes an apparatus in which a developing fluid used in an electrophotographic printing machine to develop an electrostatic latent image on a photoconductive surface is reclaimed. The developing liquid is vaporized to dry the wet copy sheet. The developing liquid vapor is pumped into the chamber of a housing and condenses in a cooling fluid, water (70), it passes therethrough. The vapors are forced through a metal pipe and finally an aerator made of porous stone that is immersed in the cooling fluid. The bubbles of liquid carrier generated therein condense as they pass through the chilled water. The water is chilled by cooling fins that extended into the housing. The fins have a refrigerant, e.g., Freon, that is pumped through the fins to maintain the temperature of water above 0° C. The developer liquid is immiscible in the water and floats on the surface thereof so as to exit from the outlet port of the chamber of the housing for recirculation to the development system. A demister is provided at the entrance to the exit stream to eliminate the mist particles (1 micron diameter) that are generated during the process.

Similarly, U.S. Pat. No. 4,733,272, Howe et al, Filter Regeneration in an Electrophotographic Printing Machine, describes a reproducing machine in which a liquid image including a liquid carrier having pigmented particles dispersed therein is transferred to a sheet of support material. In the operative mode, when the sheet of support material having the liquid image thereon is present, a fuser applies heat thereto to remove liquid carrier therefrom so as to dry the sheet of support material, and fuse the pigmented particles thereto in image configuration. In the standby mode, when the sheet of support material is not present, the fuser still generates heat. The liquid carrier is removed from the sheet of support material by the fuser and is collected in a condenser. Air flowing from the condenser passes through a filter to remove residual liquid carrier therefrom, in the standby mode, heated air from the fuser is directed to the filter to regenerate the filter. An activated carbon based filter is regenerated. In a standby mode, hot air from the fuser is directly channeled to the filter thereby regenerating it through a progressive desorption process. The stream is then guided through the heat exchanger to the condenser which strips the solvent carrier that was desorbed from the filter. The return path goes through the heat exchanger on its path back to the fuser.

U.S. Pat. No. 4,166,728, Degenhardt, discloses a process for conducting ammonia in a diazo copying machine which comprises passing ammonia-containing exhaust air by first conduit means from a developing station of the copying machine through a cooled heat exchanger in which the ammonia and water is frozen out, then heating the heat exchanger to a temperature at which the water and the ammonia are liquefied, passing the mixture of liquefied water and liquefied ammonia to a releasing station, adding fresh ammonia water to the liquefied water and to the liquefied ammonia, passing it together with the liquefied water and liquefied ammonia in the releasing station counter-currently to vapor produced by a vapor-generating means, and conducting the gaseous ammonia to the developing station, the process employing two heat exchangers, the first heat exchanger through which exhaust air is passed being cooled and the second heat exchanger being heated for liquefying the ammonia and water frozen out during the preceding process step, whereby the second heat exchanger is cooled and the first heat exchanger is heated.

Some art describes attempts to collect vapors in arts other than electrographic systems. For example, U.S. Pat. No. 4,487,616, Grossman, discloses a method for removing solvent from solvent vapor-laden air exiting a dry-cleaning machine. The solvent (dry cleaning solvent) laden air is moved through a first chamber which includes a moving film of liquid coolant (brine solution), which liquid coolant is cooled to a temperature at least as low as 20° F., and is immiscible with the solvent to be recovered, over plates located in the first chamber in contact with the solvent laden air, thereby condensing the solvent on the film of liquid coolant moving over the plates. The immiscible liquid coolant and condensed solvent is collected and separated. The liquid coolant may be moved through the first chamber in a direction counter to the direction of movement of the solvent laden air.

U.S. Pat. No. 4,252,546, Krugmann, discloses a process and apparatus for the recovery of the solvent from the exhaust air of dry cleaning machines in which the exhaust air is passed in closed circuit over a cooling device for condensation purposes. The exhaust air forced through an intensely cooled solvent immersion bath (cooled below the freezing point of water) and the water separated in the immersion bath in the form of ice crystals is drained off at an overflow together with the solvent excess formed by condensation and which raises the solvent level.

Both Grossman and Krugmann require that the cooling liquid be cooled below the freezing point of water.

Other condensation techniques are known in the art as well. For example, condensation apparatus utilizing direct contact of the vapor to be collected with cooling coils, fins and the like are described.

U.S. Pat. No. 4,766,462, Dyer et al, Liquid Carrier Recovery System, assigned to Xerox Corporation, describes a reproducing machine in which an electrostatic latent image recorded on a photoconductive member is developed with a liquid developer material comprising at least a liquid carrier having pigmented particles dispersed therein. The developed image is transferred from the photoconductive member to a sheet of support material. The sheet of support material, with the developed image thereon, passes through a housing. In the housing, heat and pressure are applied to the sheet of support material to vaporize the liquid carrier and to fuse the pigmented particles to the sheet of support material in image configuration. An interior surface of the housing is cooled by means of cooling coils mounted on the exterior surface to liquefy the vaporized liquid carrier thereon. A fan is used to direct the vapors generated at the fuser station into the wall of the housing. The supersaturated vapors condense upon contact with the wall of the housing.

U.S. Pat. No. 3,635,555, Kurahashi et al, discloses an electrophotographic copying device which uses a method and apparatus using a cooling tube with a circulating coolant to condense the vapors from an electrophotographic copying device for collection and recycling into a developing solution reservoir. Kurahashi also uses an absorbent material, such as active charcoal, to further remove developing solution vapors.

U.S. Pat. No. 4,593,480, Mair et al, discloses a paper web recording medium provided with toner images as conducted through a fixing housing containing solvent vapor over a paper deflection drum for fixing toner images on the recording medium. A low-mass paper deflection roller having low thermal conductivity is provided so that no solvent vapor can condense at the surface of the fixing drum. Cooling coils condense solvent vapors used in an image fixing station and prevent the escape of said vapors into the atmosphere.

U.S. Pat. No. 4,503,625, Manzer et al, describes a tank system for cold fixing a toner powder on a paper as it is conducted through a fixing station of a non-mechanical high speed printing and copying device. The system includes a recovery device which includes a water separator which separates condensed fixing agent from the water of the condensate. A cold sluice is used to condense a toner powder fixing solvent in a non-mechanical high speed printer.

U.S. Pat. No. 3,620,800, Tamai et al, discloses a method of improving images by evaporating a cleaning liquid reservoir, condensing the resulting cleaning liquid vapor, following the condensed cleaning liquid over the surface of a developed electrostatographic recording member to remove toner particles from the background areas as well as other contaminants and returning the spent liquid to the cleaning liquid reservoir. The vapors condense against the cooler image surface. The image cooling unit may be cooled by passing a coolant through the unit or by a Peltier device.

U.S. Pat. No. 3,767,300, Brown et al, discloses a pollution control system for an electrostatic copying machine employing a developer made up of toner suspended in a light, hydrocarbon liquid carrier in which polluted air from the region of the photoconductive surface enclosed in a generally closed cabinet is passed through a cold trap to produce a condensate made up of the carrier liquid and water in which the condensate is separated into its component parts and the carrier liquid is returned to the supply and in which the cleared air is fed to an air knife which removes excess developer from the photoconductive surface immediately following development.

In contrast, U.S. Pat. No. 3,880,515, Tanaka et al, discloses a carrier liquid vapor recovering device electrophotographic apparatus. The carrier liquid is recovered by liquefying the carrier vapor produced within the photocopying device. The carrier vapor is cooled to obtain the carrier mist which in turn is collected by the electrodes or corona charger and the drop-like carrier liquid is recovered to use it repeatedly.

U.S. Pat. No. 4,462,675, Moraw, discloses a process for thermally fixing on a support a latent electrostatic image which has been rendered visible by means of a suspension developer by applying heat and vaporizing the developing liquid, in which process the evaporating developing liquid is sucked off, condensed, separated and collected. Finely divided transport medium, atomized water or water vapor, is used to precipitate the vaporized liquid.

Some apparatus recognize the need to restrict the emission of vapor but only discuss generally techniques to recover such vapor. Examples include, U.S. Pat. No. 3,162,104, Medley, discloses a deformation image development apparatus which uses a tank (18) containing a liquid solvent which is vaporized and utilized in the apparatus and a solvent condenser (32) for condensing excess vapors.

U.S. Pat. No. 3,890,721, Katayama et al, discloses a developing liquid recovery device in a copying machine which includes the use of a heat exchanger to condense the vapors from a liquid developer in a copy machine and direct them to a reservoir. The adsorption capability of activated carbon is also utilized to recover the vapors of the carrier liquid.

U.S. Pat. No. 3,967,549, Thompson et al, discloses a ink supply system for an ink mist printer in which a condenser, precipitator, is used to recover solvent.

U.S. Pat. No. 4,122,473, Ernohazy et al, discloses a developer residue waste eliminator for diazo machines. The waste is an aqueous ammonia solution consisting of ammonia gas and steam. The ammonia gas separated from the steam and is recirculated to the developer system. The steam is condensed to form water which is conveyed to an evaporator tank and then vaporized and exhausted. The condensation operation utilizes a heat sink.

U.S. Pat. No. 4,731,635, Szlucha et al, discloses a liquid ink fusing and carrier removal system used in a reproducing machine in which an electrostatic latent image recorded on a photoconductive member is developed with a liquid developer material comprising at least a liquid carrier having pigmented particles dispersed therein. The developed image is transferred from the photoconductive member to a sheet of support material. A pair of rollers cooperate with one another to define a nip through which the sheet of support material having the developed image thereon passes. The pair of rollers apply heat and pressure to the sheet of support material having the developed image thereon. The pigmented particles are fused to the sheet of support material in image configuration and the vaporized liquid carrier removed therefrom by means of a condenser not shown.

U.S. Pat. No. 4,745,432, Langdon, discloses a reproducing machine in which an electrostatic latent image recorder on a photoconductive member is developed with a liquid developer material comprising at least a liquid carrier having pigmented particles dispersed therein. The developed image is transferred from the photoconductive member to a sheet of support material. In a housing, heat and pressure are applied to the sheet of support material to vaporize the liquid carrier and to fuse the pigmented particles to the sheet of support material in image configuration. A substantial portion of the vaporized liquid carrier and heated air are removed from the interior of the housing by a mechanical roller.

Other attempts at reducing vapor emissions include direct oxidation of the vapor. U.S. Pat. No. 4,760,423, Holtje et al, discloses an apparatus and method for reducing hydrocarbon emissions from a liquid based electrophotographic copying machine. Such hydrocarbon emissions are reduced by directing the vapors through an activated charcoal bed. Air, at an elevated temperature (100°–200° C.), is circulated through the filter for desorbing the hydrocarbon into the air stream. The air stream is delivered to a catalytic oxidation means or a condensation means. The condensation means includes a heat exchanger through which the vapors are passed. The condensate is then filtered and pumped back to the copier for reuse. A chiller is used in conjunction with the heat exchanger to reduce the temperature of the air exhausted from the charcoal bed and to facilitate condensation.

U.S. Pat. No. 4,910,108, Tavernier et al, discloses an apparatus for heat and pressure fixation of toner images. In a process of image production by the steps of developing an electrostatic charge pattern with toner particles comprised of coloring matter in a thermoplastic resin binder and dispersed in a carrier liquid and fixing the pattern-wise deposited toner particles while still damp with the carrier liquid on a support by simultaneously subjecting the same to heat and pressure, the toner particles have at 120° C. a melt viscosity when dry of from 500 to 100,000 Pa.s, a mean average diameter of from 0.1 to 5 μm, and a ratio of coloring matter to resin binder of from 1/1 to 1/9 by weight. The carrier liquid vaporized is kept out of the atmosphere by means of absorption and/or apsorption, condensation, or combustion.

U.S. Pat. No. 4,538,899, Landa et al, discloses a liquid developed electrophotocopier wherein liquid carrier dispersant transferred to a copy sheet concomitantly with the developed image is catalytically oxidized to provide harmless gaseous oxidation products a temperatures sufficiently elevated to vaporize transferred carrier and to dry and fix the transferred image. The carrier liquid has a low auto-oxidation temperature and the fixer-dryer is operated above such temperature to ensure complete oxidation (combustion) of carrier vapors even though the catalyst may have been largely rendered inactive.

U.S. Pat. No. 4,415,533, Kurotori et al, discloses a process and apparatus for treating exhaust gas from an electrophotographic machine. The odorous exhaust gas is oxidized, in the presence of a heated oxidation catalyst, to make the exhaust gas odorless.

Cooling device using Peltier elements are well known in the art. U.S. Pat. No. 2,944,404, Fritts, assigned to Minnesota Mining and Manufacturing Company, discloses an apparatus for condensing water vapor from air. A Peltier heat pump dehumidifies the air.

U.S. Pat. No. 4,687,319, Mishra, discloses an apparatus in which a developing liquid used in an electrophotographic printing machine to develop an electrostatic latent image on a photoconductive surface is reclaimed. The developing liquid is vaporized to dry the wet copy sheet. The developing liquid vapor enters the chamber of a housing where it is thermoelectrically cooled. In this way, the developing liquid vapor in the chamber of the housing liquefies. A Peltier heat pump is employed to cool the chamber of the housing so as to liquefy the developing liquid vapor. A housing condenses and recycles vaporized liquid carrier from a electrophotographic printing process. The housing consists of an array of fins located adjacent to a cooling apparatus which is a thermoelectric cooler composed of a series of Peltier chips. The vaporized liquid condenses upon contact with the surface of the fin assembly and is recirculated back to the development station for subsequent printing.

U.S. Pat. No. 5,027,145, Samuels, discloses a film processor wherein an improved heat exchanger is provided for the liquid chemicals of two of its baths. A heat exchanger consists of a thermoelectric Peltier device cools the developer at its heat sink and heats the wash water at its heat-emitting source.

U.S. Pat. No. 4,834,477, Tomita et al, discloses a method of controlling the temperature of a semiconductor laser in a optical device using a Peltier-effect element.

U.S. Pat. No. 5,229,842, Daum et al, discloses the use of Peltier devices as an electronic means for cooling the cathode regions of a fluorescent lamp.

U.S. Pat. No. 4,727,385, Nishikawa et al, discloses the use of Peltier devices as a method for lowering the humidity of the interior of an image forming apparatus. The air inside the apparatus is cooled below a level for water to condense. The water droplets are guided to a reservoir.

U.S. Pat. No. 5,073,796, Kohayakawa et al, discloses an application where a Peltier device is used to control the temperature of a cooling mechanism in an image forming apparatus. The cooling mechanism helps to remove excess heat generated by enclosed electronics.

U.S. Pat. No. 5,029,311, Brandkamp et al, describes an invention based on using a Peltier device to control the temperature of a fluorescent lamp cold spot for a document scanning system.

SUMMARY OF THE INVENTION

The present invention provides an efficient vapor control strategy for reducing vapor emissions, especially hydrocarbon emissions, in a liquid electrographic process. The process employs a developer that consists of toner particles dispersed in a liquid carrier. Some of the liquid carrier is vaporized during the image drying process which constitutes an environmental hazard if vented into the atmosphere. In order to use the printer in an office environment, it is important that an efficient liquid carrier control and, preferably, a recovery process be employed.

The vapor control system of the present invention incorporates a condenser which consists of a reservoir of cooling liquid, preferably cooled, through which the carrier vapors are sparged. The carrier vapors are condensed as they pass through the cooling liquid. The condensed carrier is then recirculated to replenish the developer. The vapor stream exiting the condenser is passed through an activated carbon filter which scavenges the residual hydrocarbon. The exit hydrocarbon concentration from the filter is less than 2.5 ppm which is considerably below the regulated emission levels.

In one embodiment, the present invention provides a vapor control system for reducing vapor emissions in an electrographic system which employs a developer having toner particles dispersed in a carrier liquid, preferably a hydrocarbon, and in which the carrier liquid is at least partially vaporized during operation of the liquid electrographic system creating vaporized carrier. A vapor collection mechanism collects at least some of the vaporized carrier from the electrographic system. A container having a vapor inlet and a vapor outlet contains a non-aqueous cooling liquid having a temperature less than the temperature of the vaporized carrier but greater than zero degrees Centigrade. A flow mechanism is operatively coupled to the vapor collection mechanism and to the vapor inlet of the container and delivers at least a portion of the vaporized carrier which has been collected within the vapor collection mechanism to the cooling liquid in the container at a point below the surface of the cooling liquid.

Preferably, the cooling liquid is miscible with the liquid carrier and is immiscible with water. Still more preferably, the liquid carrier is the cooling liquid.

In another embodiment, preferably the cooling liquid is immiscible with the liquid carrier and is immiscible with water.

In another embodiment, the present invention provides a vapor control system for reducing vapor emissions in an electrographic system employing a developer having toner particles dispersed in a carrier liquid in which the carrier liquid is at least partially vaporized during operation of the liquid electrographic system creating vaporized carrier. A vapor collection mechanism for collects at least some of the vaporized carrier from the electrographic system. A container has a vapor inlet and a vapor outlet containing a cooling liquid having a temperature less than the temperature of the vaporized carrier but greater than zero degrees Centigrade. A flow mechanism is operatively coupled to the vapor collection mechanism and to the vapor inlet of the container and creates an air pressure within the vapor collection mechanism which is less than ambient air pressure and delivers at least a portion of the vaporized carrier which has been collected within the vapor collection mechanism to the cooling liquid in the container at a point below the surface of the cooling liquid. A baffling device is positioned within the cooling liquid in the path of the bubbles of the vaporized carrier between the vapor inlet and the vapor outlet of the container.

In another embodiment, the present invention provides an electrophotographic system having a photoconductor, a charging mechanism for charging the surface of the photoconductor, a discharge mechanism for image-wise discharging the surface of the photoconductor, a developer having toner particles dispersed in a carrier liquid in which the carrier liquid is at least partially vaporized during the liquid electrophotographic system creating vaporized carrier. A vapor collection mechanism collects at least some of the vaporized carrier from the electrophotographic system. A container has a vapor inlet and a vapor outlet containing a non-aqueous cooling liquid having a temperature less than the temperature of the vaporized carrier but greater than zero degrees Centigrade. A flow mechanism is operatively coupled to the vapor collection mechanism and to the vapor inlet of the container for creating an air pressure within the vapor collection mechanism which is less than ambient air pressure and delivering at least a portion of the vaporized carrier which has been collected within the vapor collection mechanism to the cooling liquid in the container at a point below the surface of the cooling liquid. Preferably, the cooling liquid is miscible with the liquid carrier and is immiscible with water.

In another embodiment, the present invention provides an electrophotographic system having a photoconductor having a surface, a charging mechanism for charging the surface of the photoconductor, a discharge mechanism for image-wise discharging the surface of the photoconductor, and a developer having toner particles dispersed in a carrier liquid in which the carrier liquid is at least partially vaporized during the liquid electrophotographic system creating vaporized carrier. A vapor collection mechanism collects at least some of the vaporized carrier from the electrophotographic system. A container has a vapor inlet and a vapor outlet containing a cooling liquid having a temperature less than the temperature of the vaporized carrier but greater than zero degrees Centigrade. A flow mechanism is operatively coupled to the vapor collection mechanism and to the vapor inlet of the container for creating an air pressure within the vapor collection mechanism which is less than ambient air pressure and delivering at least a portion of the vaporized carrier which has been collected within the vapor collection mechanism to the cooling liquid in the container at a point below the surface of the cooling liquid. A baffling device is positioned within the cooling liquid in the path of the bubbles of the vaporized carrier between the vapor inlet and the vapor outlet of the container.

Preferably, a pressure drop is created through the cooling liquid between the vapor inlet and the vapor outlet of the container. Preferably, the flow mechanism delivers the portion of the vaporized carrier to the cooling liquid with a pressure at least as great as ambient air pressure plus the pressure drop.

Preferably, a gas dispersion mechanism disperses the vaporized carrier as the vaporized carrier enters the cooling liquid.

Preferably, the gas dispersion mechanism is a porous frit.

Preferably, the porous frit has a median pore size of from at least 10μ to not more than 1,000μ.

Preferably, the vaporized carrier bubbles through the cooling liquid between the vapor inlet and the vapor outlet of the container with bubbles of the vaporized carrier traveling at a flow rate of not more than 50 standard liters per minute and wherein the average time of residence of the bubbles of the vaporized carrier within the cooling liquid is at least 0.1 second.

Preferably, a baffling device is positioned within the cooling liquid in the path of the bubbles of the vaporized carrier.

In one embodiment, the baffling device comprises a plurality of plates, each having a plurality of perforations, each of the plurality of plates being disposed horizontally within the cooling liquid, at least some of the plurality of perforations of one of the plurality of plates being vertically misaligned with at least some of the plurality of perforations of an adjacent one of the plurality of plates.

In another embodiment, the baffling device comprises a stack consisting of a plurality of packing material.

Preferably, a cooling mechanism cools the cooling liquid.

The vaporized carrier may also contain some water vapor and at least a portion of the water vapor is condensed from the vaporized carrier along with at least some of the vaporized carrier to form water. Preferably, a liquid separating mechanism is associated with container for separating the water from the container.

Preferably, at least a portion of the condensed vaporized carrier is returned to the electrographic system for use in the developer.

Preferably, the vapor collection mechanism has an interior surface and the vapor control system further returns any of the vaporized carrier collected by the vapor collection mechanism which condenses on the interior surface of the vapor collection mechanism to the electrographic system for use in the developer.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Some embodiments of the present invention are useful in electrographic systems in addition to electrophotographic systems. Vapor control systems of the present invention may be utilized in electrographic systems in which a latent image is formed on a receptor sheet by other than photographic means such as by electrostatic means, for example.

The source of the vapors is the liquid developer which is composed of pigmented thermoplastic resin particles dispersed in a liquid aliphatic hydrocarbon carrier such as NORPAR 12, NORPAR 13 and ISOPAR G. The vapors generated should be collected and condensed in order to prevent the emission of VOCs (volatile organic compounds) into the office environment which might constitute an environmental hazard. UL (Underwriter's Laboratory) guideline #1950 for office equipment specifies that the VOC concentration inside a machine be lower than ¼ LFL (lower flammability limit) of the liquid carrier. Additionally, industrial practice restricts VOC emissions to levels lower than 1/10 TLV (threshold limit value) of the hydrocarbon liquid.

Figure 1:
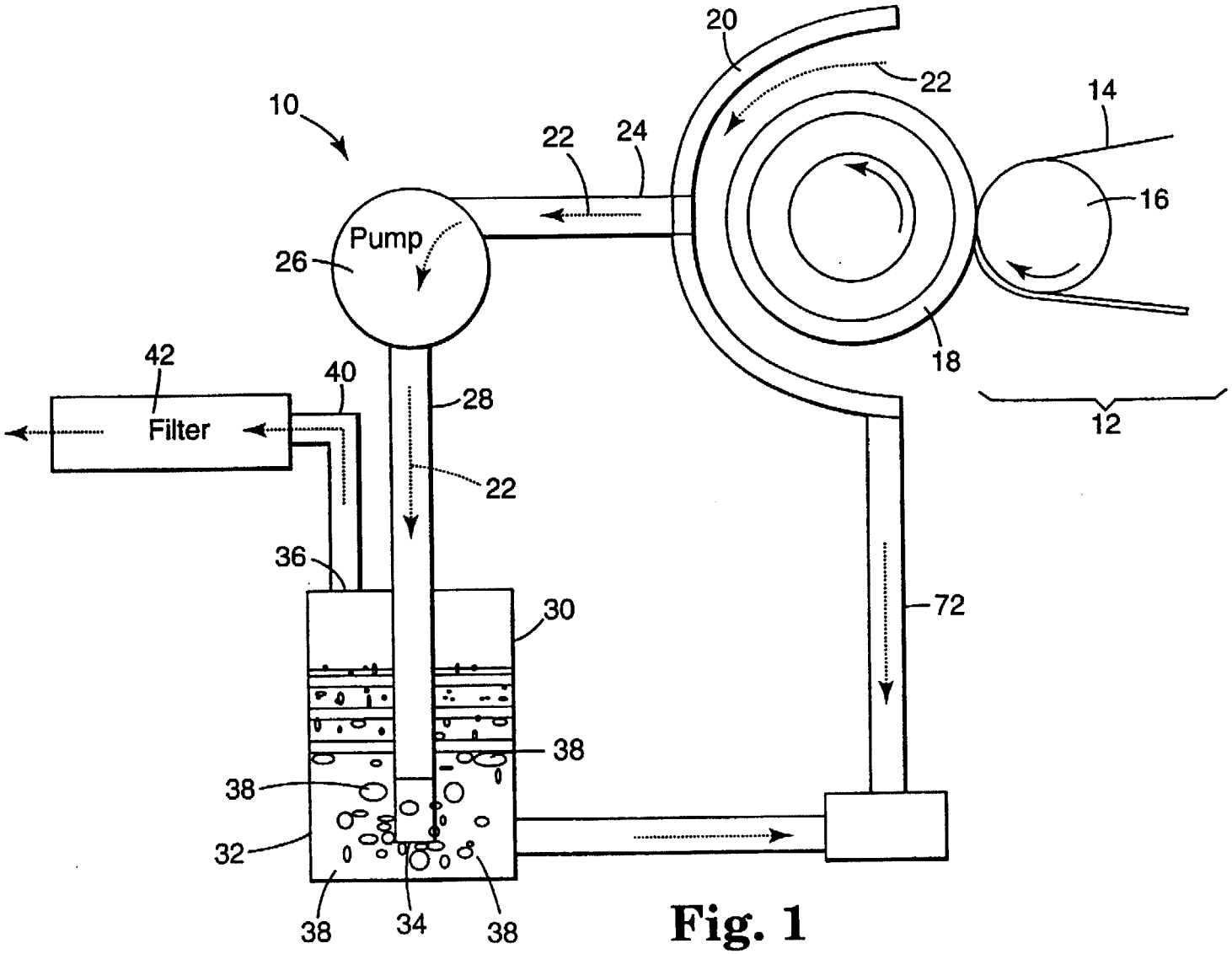
FIG. 1 illustrates a vapor control system according to a preferred embodiment of the present invention in operation in conjunction with a portion of an electrographic system.

FIG. 1 illustrates a preferred embodiment of vapor control system 10 operating in conjunction with a portion of an electrographic system 12. Organic photoconductor 14 passes around drive roller 16 carrying a developed image formed on the surface of photoconductor 14 by a liquid toner consisting of toner particles dispersed in a carrier liquid. Preferably, the liquid toner has a pigmented resin dispersed in a hydrocarbon carrier liquid such as NORPAR-12, manufactured by Exxon Corporation. As photoconductor 14 passes around drive roller 16, the developed image on the surface of photoconductor 14 is dried by drying roller 18 which is heated. As the developed image is heated and dried, excess carrier liquid is vaporized and driven from the developed image.

Housing, or shroud, 20, is positioned within electrographic system 12 to collect at least some of such vaporized carrier 22. Vaporized carrier 22 is drawn through duct 24 by pump 26. Pump 26 creates an air pressure within housing 20 which is less than surrounding air pressure in the portion of electrographic system 12 containing vapor control system 10. Other mechanisms for collecting a substantial amount of vaporized carrier 22 within housing 20 are also envisioned. Air pressure within electrographic system 12 could be higher than surrounding ambient air pressure creating a natural exit path for vaporized carrier 22 into housing 20. Also, natural convection resulting from differential temperatures could draw vaporized carrier 22 into housing 20.

Vaporized carrier 22 is delivered through duct 28 to container 30 containing cooling liquid 32, preferably a non-aqueous liquid. While characterized as a cooling liquid, cooling liquid 32 need only be slightly cooler than the temperature of vaporized carrier 22. Such temperature could be achieved by natural convection currents or simply by selective placement of container 30 within vapor control system 10. A slight difference in temperature will cause some condensation of vaporized carrier 22. Of course, it is preferred that the temperature of cooling liquid 32 be substantially less than the temperature of vaporized carrier 22 in order to effect greater condensation and, hence, greater vapor control and/or recovery. Such temperature difference is preferably achieved by a cooling mechanism discussed below.

As illustrated in FIG. 1, pump 26, by way of duct 28, delivers vaporized carrier 22 into cooling liquid 32 in container 30 at vapor inlet 34 which is below the surface of cooling liquid 32. Vaporized carrier 32 is forced, by way of pressure differential created by pump 26, to bubble through cooling liquid 32 to the surface of cooling liquid 32 and eventually to vapor outlet 36 of container 30. As bubbles 38 migrate from vapor inlet 34 to the surface of cooling liquid 32, condensation occurs rendering at least some of vaporized carrier into the liquid state. Thus, the amount of vaporized carrier 22 which reaches vapor outlet 36 is less, and preferably substantially less, than the amount of vaporized carrier entering vapor inlet 34.

Although vapor outlet 36 is shown positioned on container 30 above the surface of cooling liquid 32, this need not be the case. Vapor outlet 36 could also be located at a point below the surface of cooling liquid. Pressure could be supplied to move vaporized carrier 32 through another physical arrangement of cooling liquid 32.

Preferably, duct 40 carries excess vaporized carrier escaping from vapor outlet 36 of container 30 to filter 42. Filter 42 is constructed from activated charcoal or similar hydrocarbon scavenging material to further remove any remaining vaporized carrier 22 in the vapor expelled from container 30. Alternatively, vapor expelled from container 30 may simply be vented to ambient. This filter adsorbs sufficient vapors to render the exit VOC concentrations less than 1/10 TLV.

Optionally, vapor control system 10 includes duct 72 to return any vaporized carrier 22 which may condense on the interior surface of housing 20 to the carrier liquid supply system of electrographic system 12.

In one embodiment, cooling liquid 32 is miscible with carrier liquid (condensed vaporized carrier 22) and is immiscible with water. Preferably, carrier liquid is used as cooling liquid 32. This allows cooling liquid 32, which contains condensed vaporized carrier 22, to be recirculated back to the carrier liquid supply system of electrographic system 12.

Since it is likely that vaporized carrier 22 will also contain air containing some amount of water vapor, it is likely that water will also be condensed by cooling liquid 32. This results in a mixture of carrier liquid and water in container 30. Since cooling liquid and water are not miscible, water is easily separable from cooling liquid 32 (carrier liquid) by a simple, well known, decanting device such as a weir. Due to the immiscibility of water in hydrocarbon liquids, condensed water which has a higher density will separate into a distinct layer at the bottom of the reservoir and can be removed by several standard means such as a weir, a draining valve and other similar mechanical means. It is important that the temperature of cooling liquid be greater than zero degrees Centigrade to prevent the formation of ice crystals in cooling liquid 32.

In another embodiment, cooling liquid 32 is immiscible with both carrier liquid and water. In this embodiment, it is likely that three immiscible liquids will be present in container 30, carrier liquid, cooling liquid 30 and water. Again, simple separation techniques including decanting can be used to separate these three immiscible liquids.

While immiscibility between cooling liquid 32 and carrier liquid is preferred, it is not required in all embodiments. Where active cooling is employed, complete miscibility between cooling liquid 32 and carrier liquid is possible. Although somewhat more difficult, separation techniques exist for separating cooling liquid from carrier liquid.

Similarly, complete miscibility between cooling liquid 32, carrier liquid and water is also possible in some embodiments. Again, more complicated separation techniques are well known for separation of these components if desired.

Once separated, it is preferred to recover condensed vaporized carrier 22 by transporting such liquid back to the carrier liquid supply system of electrographic system 12.

Figure 2:
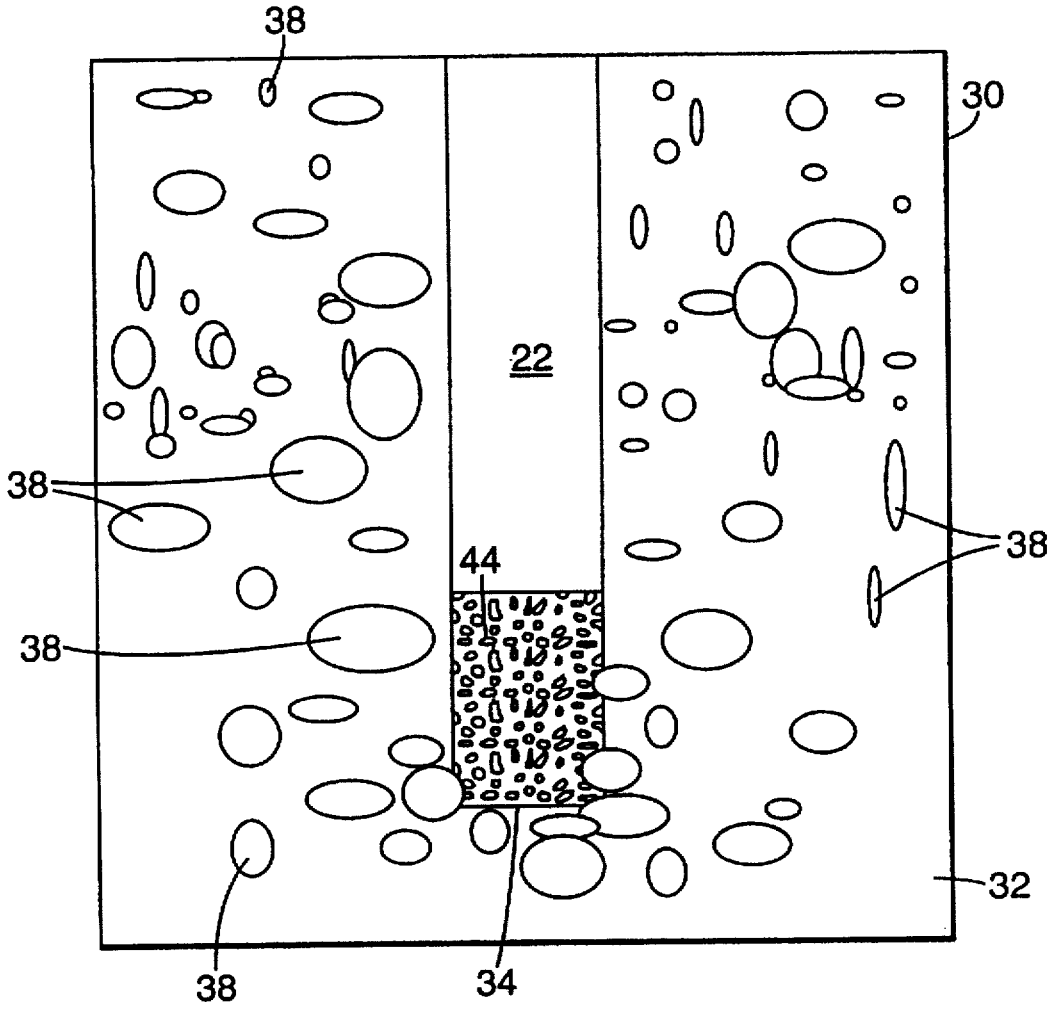
FIG. 2 is an expanded illustration of one embodiment of a container of cooling liquid used in the vapor control system of FIG. 1.

FIG. 2 illustrates an expanded view of the portion of container 30 containing cooling liquid 32. This expanded view illustrates the position of vapor inlet 34 positioned below the surface of cooling liquid 32. It also illustrates the preferred use of frit 44. Frit 44 is a stone which contains a multiplicity of pores through which vaporized carrier 22 enters cooling liquid 32. Such pores cause vaporized carrier 22 to be broken up into a greater number of smaller bubbles 38. A larger number of smaller bubbles creates a larger surface area between vaporized carrier 22 and cooling liquid 32 resulting in greater condensation and, hence, in greater vapor control. It is preferred that the majority of pores of frit 44 be the sizes of 10 microns to 1,000 microns.

Figure 3:
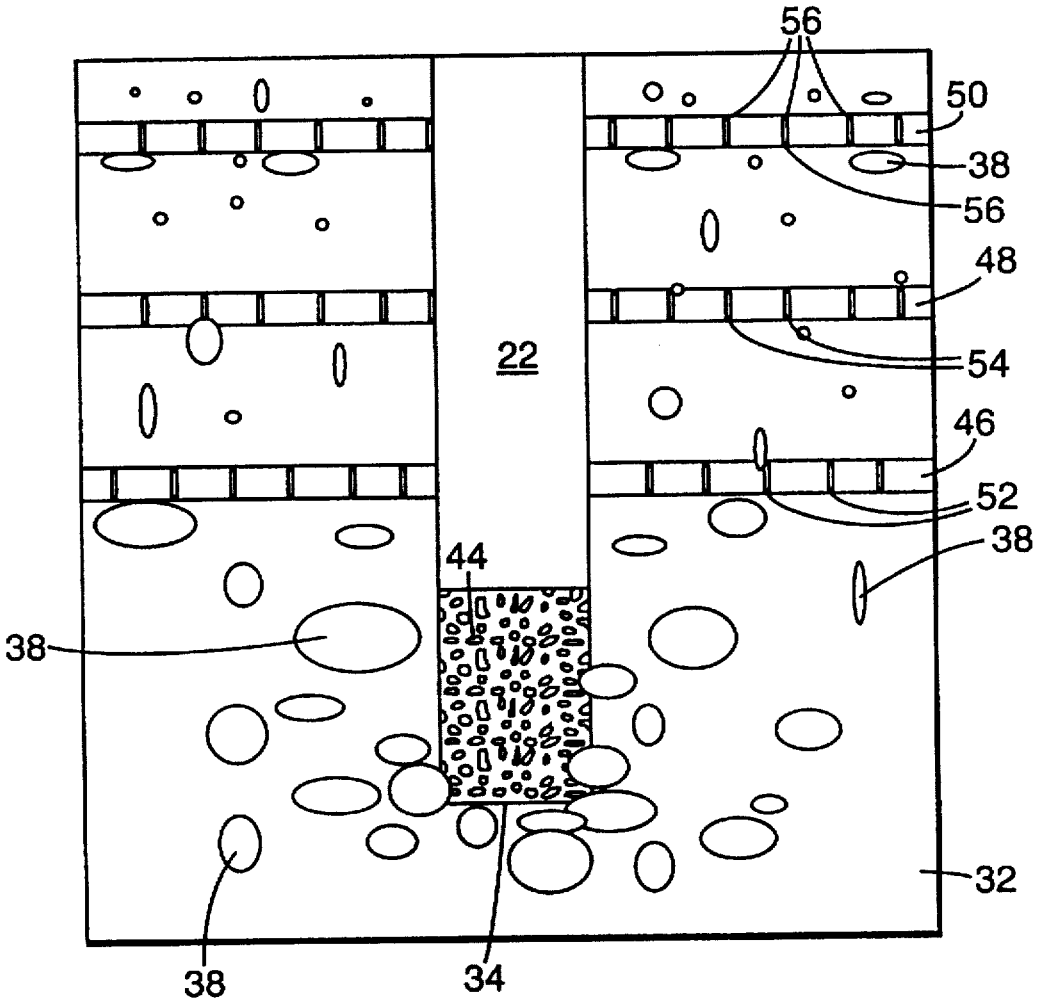
FIG. 3 is an expanded illustration of another embodiment of a container of cooling liquid used in the vapor control system of FIG. 1.

FIG. 3 illustrates an expanded view of another embodiment of the portion of container 30 containing cooling liquid 32. Vapor inlet 34 and frit 44 are constructed similarly to those elements illustrated in FIG. 2. However, container 30 illustrated in FIG. 3 also has a plurality of perforated plates 46, 48 and 50 disposed horizontally within cooling liquid 32 above vapor inlet 34. Each perforated plate 46, 48 and 50 has a plurality, and preferably a multiplicity, of perforations 52, 54 and 56, respectively. Perforations generally are sized at approximately 0.125 inches (0.318 centimeters). Plates 46, 48 and 50 with perforations 52, 54 and 56 form a baffling device which restricts movement of bubbles 38 from vapor inlet 34 to the surface of cooling liquid 32. This mechanical resistance device tends to increase the residence time of bubbles 38 within cooling liquid 32. Residence time refers to the time period which a given bubble 38 takes to traverse the distance from vapor inlet 34 to the surface of cooling liquid 32. The longer the residence time for bubbles 38, the greater the likelihood of condensation of bubbles 38 into liquid carrier. Perforations 52, 54 and 56 also tend to increase residence time of bubbles 38 and further increase condensation by limiting the size of bubble 38 which can pass through each of perforations 52, 54 and 56.

Perforations 52, 54 and 56 are intentionally vertically misaligned. That is, perforations 52 of plate 46 generally do not vertically align with perforations 54 of plate 48. Similarly, perforations 54 of plate 48 generally do not align with perforations 56 of plate 50. Such vertical misalignment helps prevent a single bubble 38 from passing through a perforation 52, for example, in plate 46 and rising directly through a perforation 54 in plate 48. If such perforations are vertically misaligned, a bubble 38 rising directly vertically through a perforation 52, for example, in plate 46 will impinge directly on a non-perforated portion of plate 48. This bubble 38 must then circulate in cooling liquid 32 until such bubble 38 finds a perforation 54 in plate 48. Such intentional circulation also tends to increase the residence time for bubbles 38 within cooling liquid 32.

Figure 4:
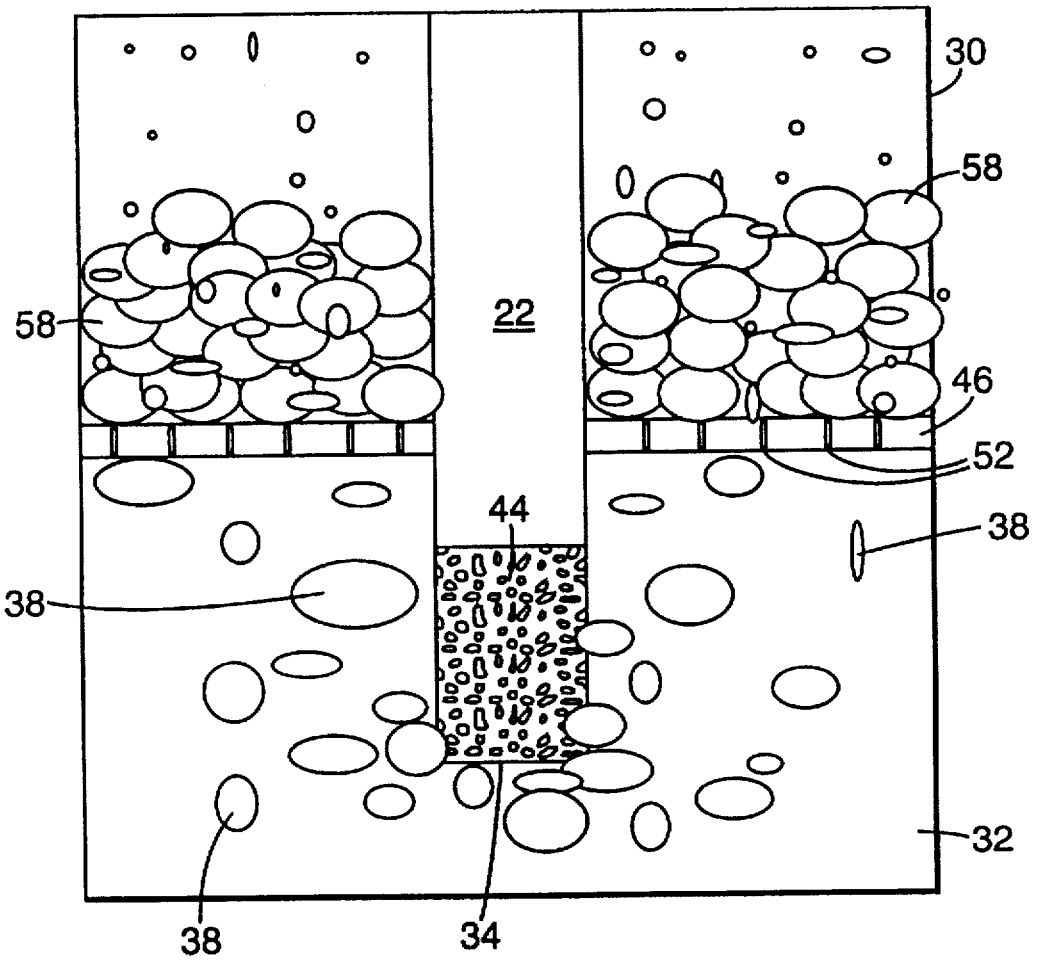
FIG. 4 is an expanded illustration of still another embodiment of a container of cooling liquid used in the vapor control system of FIG. 1.

FIG. 4 illustrates an expanded view of still another embodiment of the portion of container 30 containing cooling liquid 32. Vapor inlet 34 and frit 44 are constructed similarly to those elements illustrated in FIGS. 2 and 3. However, container 30 illustrated in FIG. 4 also has a perforated plate 46 disposed horizontally within cooling liquid 32 above vapor inlet 34. Instead of or in addition to perforated plate 46, a plurality, and preferably a multiplicity, of packed beads, similar to marbles, provide another form of mechanical resistance which restrict movement of bubbles 38 through cooling liquid 32. Bubbles 38 must make a generally circuitous route through the vacant areas between packed beads 58 to reach the surface of cooling liquid 32 or vapor outlet 36. Packed beads 58 also tend to increase residence time of bubbles 38 and further increase condensation by limiting the size of bubble 38 which can pass through between each of packed beads 58.

Figure 6:
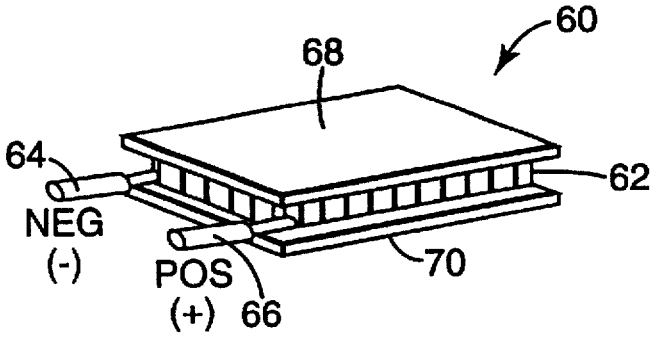
FIG. 6 illustrates a thermoelectric module which can be used for cooling in a preferred embodiment of the vapor control system illustrated in FIG. 1.

Thermoelectric module 60, illustrated in FIG. 6, can be used to provide additional cooling capacity to cooling liquid 32. Thermoelectric module 60 is based upon a standard Peltier effect element 62 with electrical wires 64 and 66 which can be connected to an electrical source (not shown). The Peltier effect creates one side 68 which is cooled and one side 70 which is warmed. Generally, thermoelectric module 60 is positioned with respect to container 30 with cold side 68 either in or adjacent to container 30 and/or cooling liquid 32. Warm side 70 is positioned away from container 30 allowing heat in cooling liquid 32 in container 30 to be transferred away from container 30.

While preferred embodiments of vapor control system 10 have been described above, more detail of a preferred electrophotographic system 110 using vapor control system 10 is described below. While the preferred electrophotographic system 110 is a four color, with liquid toner for each color plane developed in registration with previous color planes, in-line so-called "one pass" electrophotographic system, it is to be recognized and understood that vapor control system 10 is application to many other kinds of electrophotographic systems including mono-color systems and multi-color systems which do not develop images in registration or in a "single pass". Vapor control system 10 is useful wherever carrier liquid is vaporized in an electrographic process.

Figure 5:
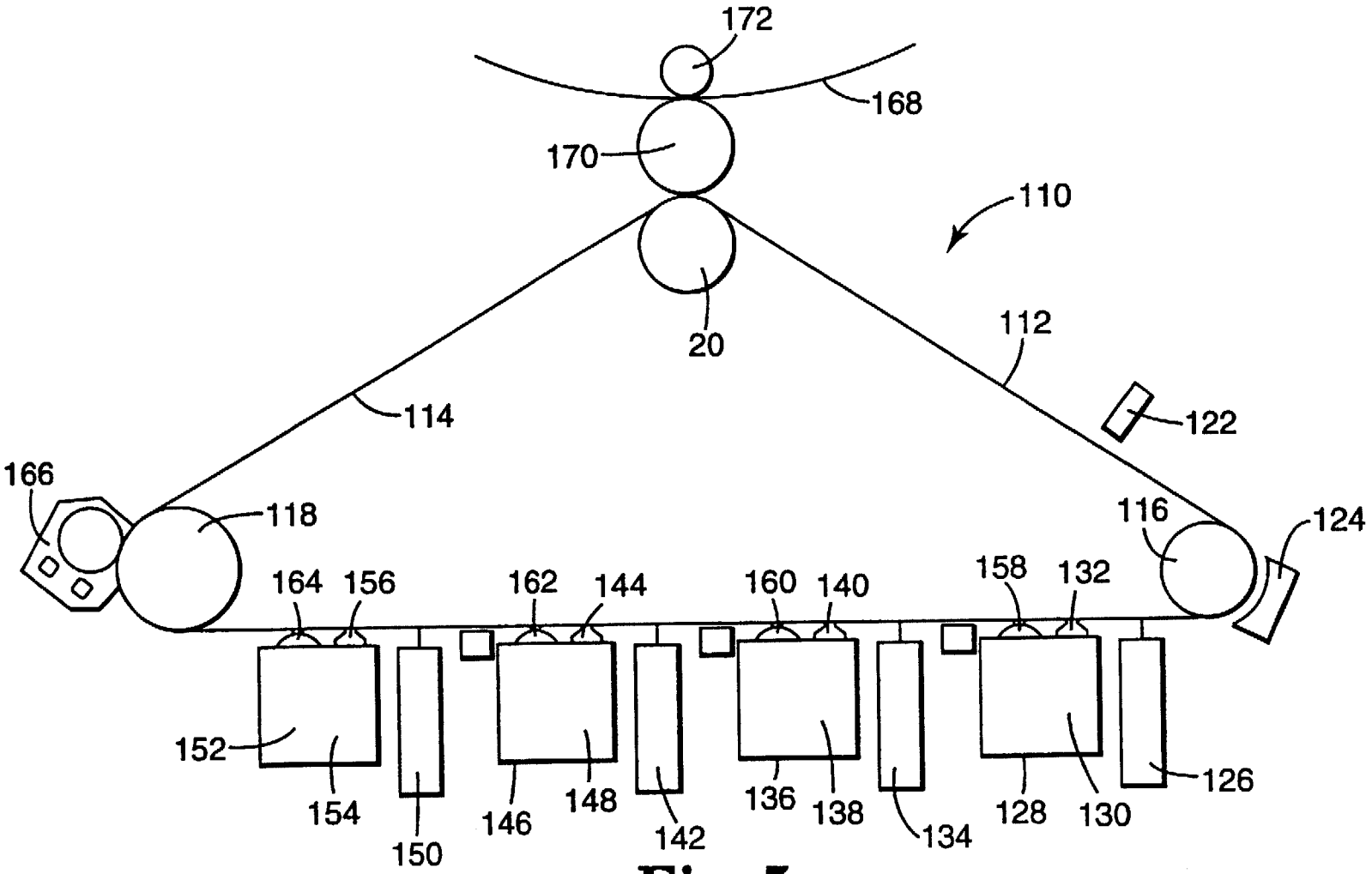
FIG. 5 is a diagrammatic illustration of a liquid electrophotographic system in which the vapor control system of FIG. 1 is useful.

Electrophotographic system 110 is illustrated diagrammatically in FIG. 5. A photoconductor 112 having a photoconductive surface is transported by belt 114 past a series of operative stations. Photoconductor 112 is mechanically supported by belt 114 which rotates in a clockwise direction around rollers (116, 118 and 120). Photoconductor 112 is first conventionally erased with erase lamp 122. Any residual charge left on photoconductor 112 after the preceding cycle is preferably removed by erase lamp 122 and then conventionally charged using charging device 124, such procedures being well known in the art. When so charged, the surface of photoconductor 112 is uniformly charged to around 600 volts, preferably. Laser scanning device 126 exposes the surface of photoconductor 112 to radiation in an image-wise pattern corresponding to a first color plane of the image to be reproduced.

With the surface of photoreceptor so image-wise charged, at developer station 128 charged pigment particles in liquid ink 130 corresponding to the first color plane will migrate to and plate upon the surface of photoconductor 112 in areas where the surface voltage of photoconductor 112 is less than the bias of electrode 130 associated with liquid ink developer station 128. The charge neutrality of liquid ink 130 is maintained by negatively charged counter ions which balance the positively charged pigment particles. Counter ions are deposited on the surface of photoconductor 112 in areas where the surface voltage is greater than the bias voltage of electrode 130 associated with liquid ink developer station 128.

At this stage, photoconductor 112 contains on its surface an image-wise distribution of plated "solids" of liquid ink 130 in accordance with a first color plane. The surface charge distribution of photoconductor 112 has also been recharged with plated ink particles as well as with transparent counter ions from liquid ink 130 both being governed by the image-wise discharge of photoconductor 112 due to laser scanning device 126. Thus, at this stage the surface charge of photoconductor 112 is also quite uniform. Although not all of the original surface charge of photoconductor 112 may have been obtained, a substantial portion of the previous surface charge of photoconductor 112 has been recaptured.

With such solution recharging, photoconductor 112 is now ready to be processed for the next color plane of the image to be reproduced.

As belt 114 continues to rotate, organic photoconductor 112 next is image-wise exposed to radiation from laser scanning device 134 corresponding to a second color plane at developer station 136. Note that this process can occur during a single revolution of organic photoconductor 112 by belt 114 and without the necessity of photoconductor 112 being subjected to erase subsequent to exposure to laser scanning device 126 and liquid ink development station 128 corresponding to a first color plane. Optionally, photoconductor 112 may be subjected to erase lamp 122 and corona charging device 124 in a subsequent rotation of belt 114. The remaining charge on the surface of photoconductor 112 is subjected to radiation corresponding to a second color plane. This produces an image-wise distribution of surface charge on photoconductor 112 corresponding to the second color plane of the image.

The second color plane of the image is then developed by developer station 136 containing liquid ink 138. Although liquid ink 138 contains "solid" color pigments consistent with the second color plane, liquid ink 138 also contains substantially transparent counter ions which, although they may have differing chemical compositions than substantially transparent counter ions of liquid ink 130, still are substantially transparent and oppositely charged to the "solid" color pigments. Electrode 140 provides a bias voltage to allow "solid" color pigments of liquid ink 138 to create a pattern of "solid" color pigments on the surface of photoconductor 112 corresponding to the second color plane. The transparent counter ions also substantially recharge photoconductor 112 and make the surface charge distribution of photoconductor 112 substantially uniform so that another color plane may be placed upon photoconductor 112 without the necessity of erase nor corona charging.

A third color plane of the image to be reproduced is deposited on the surface of photoconductor 112 in similar fashion using electrode 144 and developer station 146 containing liquid ink 148 using electrode 170. Again, the surface charge existing on photoconductor 112 following development of the third color plane may be somewhat less than existed prior to exposure to electrode 144 but will be substantially "recharged" and will be quite uniform allowing application of the fourth color plane without the necessity of erase or corona charging.

Similarly, a fourth color plane is deposited upon photoconductor 112 using laser scanning device 150 and developer station 152 containing liquid ink 154 using electrode 156.

Preferably, excess liquid from liquid inks 130, 138, 148 and 154 is "squeezed" off using a roller 158, 160, 162 and 164. Such a roller may be used in conjunction with any of developer stations 128, 136, 146 or 152 or all of them.

The plated solids from liquid inks 130, 138, 148 and 154 are dried in a drying mechanism 166. Drying mechanism 166 may be passive, may utilize active air blowers or may be other active devices such as drying rollers, vacuum devices, coronas, etc. A preferred embodiment of drying mechanism 166 is described in copending U.S. Patent Application, filed on Sep. 29, 1995, in the names of Schilli et al, entitled Drying Method and Apparatus for Electrophotography Using Liquid Toners, identified by U.S. Pat. No. 5,552,869, which is hereby incorporated by reference.

The completed four color image is then transferred, either directly to the medium 168 on which the image is to be printed, or preferably and as illustrated in FIG. 5, indirectly by way of transfer roller 170 and pressure roller 172. Typically, heat and/or pressure are utilized to fix the image to medium 168. The resultant "print" is a hard copy manifestation of the four color image.

With proper selection of charging voltages, photoconductor capacity and liquid ink, this process may be repeated an indeterminate number of times to produce a multi-colored image having an indeterminate number of color planes. Although the process and apparatus have been described above for conventional four color images, the electrophotographic system is suitable for single color images and for multi-color images having two or more color planes.

Photoconductor 112 may be a photoconductive layer applied to an electroconductive substrate, an interlayer applied to the photoconductive layer, and a release layer over the interlayer. The release layer may be a swellable polymer. By swellable is meant that the polymer is capable of absorbing carrier liquid in amounts greater than 150% of the weight of the polymer. If desired, the release layer may have rough surface, preferably with an $R_a$ from about 110 nanometers to about 1100 nanometers.

The release layer may be a swellable polymer formed by cross linking a high molecular weight hydroxy terminated siloxane. More preferably, the release layer is the reaction product of a high molecular weight hydroxy terminated siloxane, a low molecular weight hydroxy terminated siloxane, and a cross-linking agent. If such a combination is used, the weight ratio of high molecular weight hydroxy terminated siloxane to low molecular weight hydroxy terminated siloxane is preferably in the range from 0.5:1 to 1100:1, more preferably in the range from 1:1 to 120:1.

A preferred embodiment for photoconductor 112 is described in Example 6 of U.S. Pat. Ser. No. 5,652,078, which is hereby incorporated by reference.

Charging device 124 is preferably a scorotron type corona charging device. Charging device 124 has grid wires (not shown) coupled to a suitable positive high voltage source of plus 4,000 to plus 8,000 volts. The grid wires of charging device 124 are disposed from about 1 to about 3 millimeters from the surface of photoconductor 112 and are coupled to an adjustable positive voltage supply (not shown) to obtain an apparent surface voltage on photoconductor 112 in the range plus 600 volts to plus 1000 volts or more depending upon the capacitance of photoconductor. While this is the preferred voltage range, other voltages may be used. For example, thicker photoconductors typically require higher voltages. The voltage required depends principally on the capacitance of photoconductor 112 and the charge to mass ratio of the liquid ink utilized as the toner for electrophotographic system 110. Of course, connection to a positive voltage is required for a positive charging photoconductor 112. Alternatively, a negatively charging photoconductor 112 using negative voltages would also be operable. The principles are the same for a negative charging photoconductor 112.

Laser scanning device 126 imparts image information associated with a first color plane of the image, laser scanning device 134 imparts image information associated with a second color plane of the image, laser scanning device 166 imparts image information associated with a third color plane of the image and laser scanning device 150 imparts image information associated with a fourth color plane of the image. Although each of laser scanning devices 126, 134, 142 and 150 are associated with a separate color of the image and operate in the sequence as described above with reference to FIG. 5, for convenience they are described together below.

Laser scanning devices 126, 134, 142 and 150 include a suitable source of high intensity electromagnetic radiation. The radiation may be a single beam or an array of beams. The individual beams in such an array may be individually modulated. The radiation impinges, for example, on photoconductor 112 as a line scan generally perpendicular to the direction of movement of photoconductor 112 and at a fixed position relative to charging device 124.

The radiation scans and exposes photoconductor 112 preferably while maintaining exact synchronism with the movement of photoconductor 112. The image-wise exposure causes the surface charge of photoconductor 112 to be reduced significantly wherever the radiation impinges. Areas of the surface of photoconductor 112 where the radiation does not impinge are not appreciably discharged. Therefore, when photoconductor 112 exits from under the radiation, its surface charge distribution is proportional to the desired image information.

The wavelength of the radiation to be transmitted by laser scanning devices 134, 142 and 150 is selected to have low absorption through the first three color planes of the image. The fourth image plane is typically black. Black is highly absorptive to radiation of all wavelengths which would be useful in the discharge of photoconductor 112. Additionally, the wavelength of the radiation of laser scanning devices 126, 134, 142 and 150 selected should preferably correspond to the maximum sensitivity wavelength of photoconductor 112. Preferred sources for laser scanning devices 126, 134, 142 and 150 are infrared diode lasers and light emitting diodes with emission wavelengths over 700 nanometers. Specially selected wavelengths in the visible may also be usable with some combinations of colorants. The preferred wavelength is 780 nanometers.

The radiation (a single beam or array of beams) from laser scanning devices 126, 134, 142 and 150 is modulated conventionally in response to image signals for any single color plane information from a suitable source such as a computer memory, communication channel, or the like. The mechanism through which the radiation from laser scanning devices is manipulated to reach photoconductor 112 is also conventional.

The radiation strikes a suitable scanning element such as a rotating polygonal mirror (not shown) and then passes through a suitable scan lens (not shown) to focus the radiation at a specific raster line position with respect to photoconductor 112. It will of course be appreciated that other scanning means such as an oscillating mirror, modulated fiber optic array, waveguide array, or suitable image delivery system may be used in place of or in addition to a polygonal mirror. For digital halftone imaging, it is preferred that radiation should be able to be focused to diameters of less than 42 microns at the one-half maximum intensity level assuming a resolution of 600 dots per inch. A lower resolution may be acceptable for some applications. It is preferred that the scan lens must be able to maintain this beam diameter across at least a 12 inches (30.5 centimeters) width.

The polygonal mirror typically is rotated conventionally at constant speed by controlling electronics which may include a hysteresis motor and oscillator system or a servo feedback system to monitor and control the scan rate. Photoconductor 112 is moved orthogonal to the scan direction at constant velocity by a motor and position/velocity sensing devices past a raster line where radiation impinges upon photoconductor 112. The ratio between the scan rate produced by the polygonal mirror and photoconductor 112 movement speed is maintained constant and selected to obtain the required addressability of laser modulated information and overlap of raster lines for the correct aspect ratio of the final image. For high quality imaging, it is preferred that the polygonal mirror rotation and photoconductor 112 speed are set so that at least 600 scans per inch, and still more preferably 1200 scans per inch, are imaged on photoconductor 112. It is preferable not to have photoconductor 112 travel substantially faster than about 3 inches/second (7.6 centimeters/second).

Developer station 128 develops the first color plane of the image, developer station 136 develops the second color plane of the image, developer station 146 develops the third color plane of the image and developer station 152 develops the fourth color plane of the image. Although each of developer stations 128, 136, 146 and 152 are associated with a separate color of the image and operate in the sequence as described above with reference to FIG. 5, for convenience they are described together below.

Conventional liquid ink immersion development techniques are used in developer stations 128, 136, 146 and 152. Two modes of development are known in the art, namely deposition of liquid ink 130, 138, 148 and 154 in exposed areas of photoconductor 112 and, alternatively, deposition of liquid ink 130, 138, 148 and 154 in unexposed regions. The former mode of imaging can improve formation of halftone dots while maintaining uniform density and low background densities. Although the invention has been described using a discharge development system whereby the positively charged liquid ink 130, 138, 148 and 154 is deposited on the surface of photoconductor 112 in areas discharged by the radiation, it is to be recognized and understood that an imaging system in which the opposite is true is also contemplated by this invention. Development is accomplished by using a uniform electric field produced by development electrodes 132, 140, 144 and 156 spaced near the surface of photoconductor 112.

Developer stations 128, 136, 146 and 152 consist of a developer roll, squeegee roller 158, 160, 162 and 164, fluid delivery system, and a fluid return system. A thin, uniform layer of liquid ink 130, 138, 148 and 154 is established on a rotating, cylindrical developer roll (electrode) 132, 140, 144 and 156. A bias voltage is applied to the developer roll (electrode) intermediate to the unexposed surface potential of photoconductor 112 and the exposed surface potential level of photoconductor 112. The voltage is adjusted to obtain the required maximum density level and tone reproduction scale for halftone dots without any background being deposited. Developer roll (electrode) 132, 140, 144 and 156 is brought into proximity with the surface of photoconductor 112 immediately before the latent image formed on the surface of photoconductor 112 passes beneath the developer roll (electrode) 132, 140, 144 and 156. The bias voltage on developer roll (electrode) 132, 140, 144 and 156 forces the charged pigment particles, which are mobile in the electric field, to develop the latent image. The charged "solid" particles in liquid ink 130, 138, 148 and 154 will migrate to and plate upon the surface of photoconductor 112 in areas where the surface charge of photoconductor 112 is less than the bias voltage of developer roll (electrode) 132, 140, 144 and 156. The charge neutrality of liquid ink 130, 138, 148 and 154 is maintained by oppositely-charged substantially transparent counter ions which balance the charge of the positively charged ink particles. Counter ions are deposited on the surface photoconductor 112 in areas where the surface voltage of photoconductor 112 is greater than the electrode bias voltage.

After plating is accomplished by developer roll (electrode) 132, 140, 144 and 156, squeegee rollers 158, 160, 162 and 164 then rolls over the developed image area on photoconductor 112 removing the excess liquid ink 130, 138, 148 and 154 and successively leaving behind each developed color plane of the image. Alternatively, sufficient excess liquid ink remaining on the surface of photoconductor 112 could be removed in order to effect film formation by vacuum techniques well known in the art. The ink deposited onto photoconductor 112 should be rendered relatively firm (film formed) by the developer roll (electrode) 132, 140, 144 and 156, squeegee rollers 158, 160, 162 and 164 or an alternative drying technique in order to prevent it from being washed off in a subsequent developing process(es) by developer stations 136, 146 and 152. Preferably, the ink deposited on photoconductor should be dried enough to have greater than seventy-five percent by volume fraction of solids in the image.

Preferred squeegee rollers 158, 160, 162 and 164 are described in copending U.S. Patent Application, filed Sep. 29, 1995, in the names of Moe et al, entitled Squeegee Apparatus and Method for Removing Developer Liquid from an Imaging Substrate and Fabrication Method, identified by U.S. patent application Ser. No. 08/537,128, which is hereby incorporated by reference. Developer rolls (electrodes) 132, 140, 144 and 156 are kept clean by a developer cleaning roller as described in copending U.S. Patent Application, filed on Sep. 29, 1995, entitled Apparatus and Method for Cleaning Developer from an Imaging Substrate, identified by U.S. Pat. No. 5,596,398, which is hereby incorporated by reference. Any further excess ink is removed by an additional roller described in copending U.S. Patent Application, filed on Sep. 29, 1995, entitled Apparatus and Method for Removing Excess Ink from an Imaging Substrate, identified by U.S. patent application Ser. No. 08/536,136 which is hereby incorporated by reference. The overall developer apparatus is described in detail in copending U.S. Patent Application, filed on Sep. 29, 1995, in the names of Teschendorf et al, entitled Development Apparatus for an Electrographic System, identified by U.S. Pat. No. 5,576,815 which is hereby incorporated by reference.

Developer stations 128, 136, 146 and 152 are similar to that described in U.S. Pat. No. 5,130,990, Thompson et al, which is hereby incorporated by reference. The preferred developer stations 128, 136, 146 and 152 differ from those described in the Thompson et al patent in that the preferred spacing between the developer roll surface and the surface of photoconductor 112 is 150 microns (0.15 millimeters) instead of 50–75 microns (0.05–0.075 millimeters). Further, no wiper roller is used and squeegee rollers 158, 160, 162 and 164 are made of urethane. Once the development process for each color plane of the image is complete, the appropriate developer roll (electrode) 132, 140, 144 and 156 is retracted from the surface of photoconductor 112, breaking the contact between liquid inks 130, 138, 148 and 154 and the surface of photoconductor 112. The developer rolls (electrode) 132, 140, 144 and 156 dripline fluid is removed and captured by squeegee rollers 158, 160, 162 and 164.

The dripline of liquid inks 130, 138, 148 and 154 supplied by developer rolls (electrode) 130, 140, 144 and 156 on photoconductor 112 advances toward squeegee rollers 158, 160, 162 and 164 as photoconductor 112 moves on belt 114 and combines with liquid inks 130, 138, 148 or 154, respectively, already contained at the leading edge of squeegee rollers 158, 160, 162 and 164 (squeegee holdup volume). The excess liquid inks 130, 138, 148 and 154 from the dripline and the squeegee holdup volume will overflow down the front surface of squeegee rollers 158, 160, 162 and 164, a portion of it flowing into the fluid return system. After the imaged area of photoconductor 112 is past squeegee rollers 158, 160, 162 and 164, a doctor blade (not shown) is brought into contact with the bottom of each squeegee roller 158, 160, 162 and 164. At the same time, squeegee rollers 158, 160, 162 and 164 begin rotating in the direction opposite the moving surface of photoconductor 112 with a velocity of approximately 10 inches per second (25.4 centimeters per second). The fluid of liquid inks 130, 138, 148 and 154 in the nip of squeegee rollers 158, 160, 162 and 164 is taken away from the surface of photoconductor 112 by the motion of squeegee rollers 158, 160, 162 and 164 and skived off squeegee rollers 158, 160, 162 and 164 by the doctor blade, from which it drains into the fluid return system. The rate at which the liquid ink 130, 138, 148 or 154 can be removed is a function of the velocity ratio of the surface of photoconductor 112 to the surface of squeegee rollers 158, 160, 162 and 164. It is preferred that the doctor blade maintain intimate contact with the entire lateral width of the squeegee rollers 158, 160, 162 and 164 so that the doctor blade cannot swell or warp. The preferred material for the doctor blade is 3M brand Fluoroelastomer FC 2174, which is inert to liquid ink, manufactured by Minnesota Mining and Manufacturing Company, St. Paul, Minn.

If the composition of liquid inks 130, 138, 148 and 154 and the parameters governing the time constants in the development process are appropriately selected, the surface potential distribution on photoconductor 112 as it exits from developer stations 128, 136, 146, 152 may be uniform and nearly equal to the bias voltage on electrode 132, as a result of the deposition of positively charged pigment particles in the areas where the surface potential of photoconductor 112 was less than the bias of electrode 132 (imaged areas) and the deposition of negatively charged counter ions in the areas where the surface potential of photoconductor 112 was greater than the bias of electrode 132 (non-imaged areas).

Erase lamp 122 or charging device 124 are not necessary before exposing subsequent color planes of the image. If the bias voltage of electrode 132 for the first color plane is carefully selected such that the charge distribution on photoconductor 112 as it exits developer station 128 is of necessary and sufficient amplitude to serve as the charge-up value for the second color plane of the image.

The latent image for the second color separation, formed by the second color plane of the image, is then developed in the same manner as described for the first color separation. The exposure and development steps may be repeated a number of times wherein each repetition may image-wise expose a separate color plane, such as yellow, magenta, cyan or black, and each development ink may be of a separate color corresponding to the image-wise exposed color plane. Superposition of four such color planes may be achieved with good registration onto a photoconductor surface without transferring any of the planes until all have been formed. The order of imaging and developing for the individual color separations of the full color image is not fixed but may be chosen to suit the process in hand and depends only on the final image requirements.

The description and calculations shown below for vapor control system 10 reflect values for NORPAR 12 for the liquid carrier in the developer.

NORPAR 12 vapors have been determined to be generated at the rate of 500 mg/min (30 gms/hr) to 833 mg/min (50 gms/hr) when printing at the rate of 9 pages per minute to 15 pages per minute respectively. The objective is to effectively condense the vapors, recover the liquid carrier and ensure compliance with above mentioned environmental regulatory requirements. The immediate and primary objective is to ensure that the vapor concentration does not exceed ¼ LFL, which for NORPAR 12 is 3750 ppm. This limitation on the vapor concentration can be met by sustaining an appropriate air flow through the manifold or by ensuring that the temperature of the manifold is maintained below a temperature at which the saturation concentration is ¼ LFL. The saturation concentration of Norpar 12 at 54° C. is 3750 ppm which is ¼ LFL. The preferred approach to meet the primary safety criterion is to limit the wall temperature of the manifold to 54° C. Norpar 12 vapors in excess of the saturation concentration at 54° C. will condense on the inner surfaces of the manifold which are then recycled back to the developer container for subsequent use in printing. Under these conditions a nominal air flow between 3 to 5 liters/min (an average of 4 liters/min) through the manifold at the image drying station will be sufficient to maintain the concentration of the vapor laden air below the stipulated limit of ¼ LFL or 3750 ppm. An air moving means is used to deliver the vapors to a condenser. This air moving means may consist of a fan, blower, pump or any other similar device that is capable of overcoming the pressure drop in the condenser and, possibly, any adsorption device attached in series with the condenser as described above.

The efficiency and rate of condensation can be greatly enhanced by cooling the liquid reservoir. The liquid reservoir can be operated at any temperature in the range between the pour point of the liquid and room temperature (25° C.). In a preferred embodiment, liquid NORPAR 12 is cooled to a temperature range between 0° C. to 50° C., more preferably in the range between 0° C. and 20° C. and most preferably in the range between 5° C. and 15° C.

The residence time of the vapors has been found to be an important parameter governing the overall efficiency of the condenser. The residence time of the vapors at a given flow rate through a given volume of liquid can be increased by one of many methods such as incorporating a series of perforated trays, packed bed of beads, fine screen mesh, or an arrangement of baffles. In addition to increasing residence time, this approach causes a reduction in the size of the vapor bubbles which results in increased contact area between the bubbles and the liquid coolant yielding higher condensation efficiencies.

Although a preferred embodiment employs in the condenser a liquid that is miscible with the vapors, it should be noted that a non-aqueous, immiscible liquid can also be used to achieve similar results.

The following analytical techniques were used to quantify the concentration of the volatile organic compound (VOC). The VOC concentration in a given vapor stream was measured using a portable Toxic Vapor Analyzer, model TVA 1000 (Foxboro Company, East Bridgewater, Mass.). The instrument is equipped with a Flame Ionization Detector (FID) which provides an instantaneous reading of the total VOC concentration in a sample. Data logging and storage were done automatically at the rate of one concentration reading every four seconds and retrieved by a computer for data analysis. As the vapors enter the detector, there is a rapid increase in the FID detector output followed by a plateau which represents the average VOC concentration in the stream. A sampling time period of two minutes allowed enough time for the FID detector to attain the plateau regime thereby enabling an accurate average concentration to be measured using this technique. Measurements made using the above mentioned procedure were found to have good reproducibility with a standard deviation of less than ten. The FID detector output is however, only an apparent VOC concentration [$HC_{app}$] measurement and requires an appropriate calibration to convert to a true concentration [$HC_{true}$] measurement of the specific vapors in the stream. The VOCs relevant to this study are mixtures of aliphatic hydrocarbons (decane, undecane, dodecane and tridecane) such as those found in NORPAR 12, NORPAR 13 and ISOPAR G.

Calibration is accomplished using a sorbent tube sampling technique which is an established industrial hygiene air sampling technique used for monitoring hazardous gases and vapors in air. Charcoal sorbent tubes (8 mmOD×110 mm length) from SKC Inc.(Eighty Four, Pa.); were used for calibrating the TVA 1000 to liquid carrier vapors. The sorbent tube was attached to a portable pump (SKC Inc., Eighty Four, Pa.) and the vapor stream was sampled for 5 minutes at a flow rate of 1.5 liters/min. Flow rates and sampling times were set so that the sample collected did not exceed the capacity of a charcoal sorbent tube. Following sampling, the sorbent was removed from the glass tube, placed in a sample vial and mixed vigorosly with two milliliters of carbon disulfide for 30 minutes in order to desorb the analytes of interest. The carbon disulfide was subsequently analyzed by gas chromatography to determine the true VOC concentration in a given stream. The equivalent apparent concentrations (from the TVA 1000) are plotted as a function of the true concentrations (from gas chromatography) at different VOC levels in the vapor stream. This calibration was found to have a logarithmic relationship that obeyed the following equation:

$$\log_{10}[HC_{app}] = \{0.622*\log_{10}[HC_{true}]\} + 1.716$$

The technique described above however fails to yield accurate results when concentrations near ¼ LFL are approached. This is due to the fact that the vapor temperature required to achieve this saturation concentration, i.e. ~55° C., is significantly greater than room temperature. Therefore, when a vapor sample is drawn into the TVA 1000 at this elevated temperature, the less volatile components of the vapor mixture tend to condense upon contact with the tubing upstream from the FID detector because the tubing exists at room temperature. This prevents a substantial portion of the vapors from reaching the detector cell causing the instrument to underestimate the true VOC concentration. A gravimetric based method was therefore devised to eliminate this deficiency in the measurement technique. Bulk weight measurements were made on the source of vapors, i.e. liquid carrier container, before and after an experiment. The total loss in weight, which is directly related to vapor generation, is then time averaged over the course of the experiment and reported as an average ppm value using the equation shown below.

$$ppm = \left(m_v \frac{\text{gms}}{\text{hr}}\right)\left(22.4 \frac{lit}{\text{gmol}}\right)\left(\frac{1}{Q_v} \frac{\text{min}}{lit}\right)\left(M_w \frac{\text{gm}}{\text{gmole}}\right)\left(\frac{1}{60} \frac{\text{hr}}{\text{min}}\right)\left(\frac{1}{10^{-6}}\right)$$

Results of tests conducted with various parameters discussed above with respect to vapor control system 10 are described below in the following tables.

| Egs | $V_{cond}$ (ml) | $T_{cond}$ min. °C. | $\tau_r$ (sec.) | $[HC]_{in}$ (ppm) | $[HC]_{out}$ (ppm) | $[HC]_{satn.}$ (ppm) | $[HC]_{out}$-$[HC]_{satn.}$ | $T_{vap}$-$T_{cond}$ |
|---|---|---|---|---|---|---|---|---|
| Residence time/Coolant volume effect: Flow rate: 3.75 lit/min; Vapor temp.: 56° C. Condenser: Cylinder cooled with jacket of ice water | | | | | | | | |
| 1 | 67 | 0 | 1.1 | 3830 | 110 | 69 | 41 | 56 |
| 2 | 67 | 0 | >1.1 | 3830 | 71 | 69 | 2 | 56 |
| 3 | 100 | >0 | >1.6 | 3830 | 98 | 69 | 29 | 56 |
| 4 | 135 | >0 | >2.2 | 3830 | 112 | 69 | 43 | 56 |
| Condenser: packed bed Flow rate: 4 lit/min.; Vapor temp: 56° C. Condenser: Cylinder packed with spherical ceramic beads, average dia: 0.185 cm | | | | | | | | |
| 5 | 150 | 10 | >0.8 | 4022 | 181 | 163 | 18 | 46 |
| Temperature of coolant: Flow rate: 4 lit/min; Vapor temp.: 58° C. Condenser: Cylinder cooled with jacket of ice water | | | | | | | | |
| 6 | 67 | 19 | >1.0 | 3779 | 353 | 333 | 20 | 39 |
| 7 | 67 | 10 | >1.0 | 3779 | 177 | 163 | 14 | 48 |
| 8 | 67 | 0 | >1.0 | 3779 | 71 | 69 | 2 | 58 |
| Preferred embodiment: Flow rate: 3.1 lit/min; Vapor temp.: 53° C. Condenser: Cylinder with Pelter cooling elements adjacent to bottom | | | | | | | | |
| 9 | 100 | 1 | >2 | 3779 | 122 | 75 | 47 | 52 |
| Use of other hydrocarbon liquids: Flow rate: 4.1 lit/min; Vapor temp.: 56° C. Condenser: Cylinder with Pelter cooling elements adjacent to bottom | | | | | | | | |
| Condensation of NORPAR 13 vapors | | | | | | | | |
| 10 | 100 | 5 | >1.1 | 3625 | 48 | 26 | 22 | 53 |
| Condensation of ISOPAR G | | | | | | | | |
| 11 | 100 | 10 | >1.1 | 23686 | 5810 | 1368 | 4442 | 51 |
| Use of Fluorinert™ (PF 5050) as coolant in condenser | | | | | | | | |
| 12 | 105 | 2 | >2 | 4022 | 110 | 82 | 28 | 54 |

While the present invention has been described with respect to it preferred embodiments, it is to be recognized and understood that changes, modifications and alterations in the form and in the details may be made without departing from the scope of the following claims.

What is claimed is:

1. A vapor control system for reducing vapor emissions in an electrographic system employing a developer having toner particles dispersed in a carrier liquid in which said carrier liquid is at least partially vaporized during operation of said liquid electrographic system creating vaporized carrier having a temperature, comprising:

vapor collection means for collecting at least some of said vaporized carrier from said electrographic system;

a container having a vapor inlet and a vapor outlet containing a non-aqueous cooling liquid, said cooling liquid having a temperature less than said temperature of said vaporized carrier but greater than zero degrees Centigrade; and flow means operatively coupled to said vapor collection means and to said vapor inlet of said container for delivering at least a portion of said vaporized carrier which has been collected within said vapor collection means to said cooling liquid in said container at a point below the surface of said cooling liquid;

wherein pressure drop is created through said cooling liquid between said vapor inlet and said vapor outlet of said container and wherein said flow means delivers said portion of said vaporized carrier to said cooling liquid with a pressure at least as great as ambient air pressure plus said pressure drop;

wherein said carrier liquid is a hydrocarbon carrier liquid; and wherein said cooling liquid is miscible with said liquid carrier and is immiscible with water;

whereby at least some of said vaporized carrier is condensed into said liquid carrier by said cooling liquid.

2. A vapor control system as in claim 1 wherein said liquid carrier is said cooling liquid.

3. A vapor control system as in claim 1 further comprising a gas dispersion means for dispersing said vaporized carrier as said vaporized carrier enters said cooling liquid.

4. A vapor control system as in claim 3 wherein said gas dispersion means comprises a porous frit.

5. A vapor control system as in claim 4 wherein said porous frit has a median pore size of from at least 10μ to not more than 1,000μ.

6. A vapor control system as in claim 1 wherein said vaporized carrier bubbles through said cooling liquid between said vapor inlet and said vapor outlet of said container with bubbles of said vaporized carrier traveling at a flow rate of not more than 50 standard liters per minute and wherein the average time of residence of said bubbles of said vaporized carrier within said cooling liquid is at least 0.1 second.

7. A vapor control system as in claim 1 further comprising a baffling device positioned within said cooling liquid in the path of said bubbles of said vaporized carrier.

8. A vapor control system as in claim 7 wherein said baffling device comprises a plurality of plates, each having a plurality of perforations, each of said plurality of plates being disposed horizontally within said cooling liquid, at least some of said plurality of perforations of one of said plurality of plates being vertically misaligned with at least some of said plurality of perforations of an adjacent one of said plurality of plates.

9. A vapor control system as in claim 7 wherein said baffling device comprises a stack consisting of a plurality of packing material.

10. A vapor control system for reducing vapor emissions in an electrographic system employing a developer having toner particles dispersed in a carrier liquid in which said carrier liquid is at least partially vaporized during operation of said liquid electrographic system creating vaporized carrier having a temperature, comprising:

vapor collection means for collecting at least some of said vaporized carrier from said electrographic system;

a container having a vapor inlet and a vapor outlet containing a non-aqueous cooling liquid, said cooling liquid having a temperature less than said temperature of said vaporized carrier but greater than zero degrees Centigrade; and cooling means for cooling said cooling liquid; and flow means operatively coupled to said vapor collection means and to said vapor inlet of said container for delivering at least a portion of said vaporized carrier which has been collected within said vapor collection means to said cooling liquid in said container at a point below the surface of said cooling liquid;

wherein a pressure drop is created through said cooling liquid between said vapor inlet and said vapor outlet of said container and wherein said flow means delivers said portion of said vaporized carrier to said cooling liquid with a pressure at least as great as ambient air pressure plus said pressure drop;

wherein said vaporized carrier also contains some water vapor and wherein at least a portion of said water vapor is condensed from said vaporized carrier along with at least some of said vaporized carrier to form water, said vapor control system further comprising liquid separating means associated with container for separating said water from said container;

wherein said at least a portion of said condensed vaporized carrier is returned to said electrographic system for use in said developer; and wherein said vapor collection means has an interior surface, said vapor control system further comprising returns means associated with said vapor collection means for returning any of said vaporized carrier collected by said vapor collection means which condenses on said interior surface of said vapor collection means to said electrographic system for use in said developer.

11. A vapor control system as in claim 10 wherein said vaporized carrier bubbles through said cooling liquid between said vapor inlet and said vapor outlet of said container with bubbles of said vaporized carrier traveling at a flow rate of not more than 50 standard liters per minute and wherein the average time of residence of said bubbles of said vaporized carrier within said cooling liquid is at least 0.1 second.

12. A vapor control system as in claim 11 further comprising a baffling device positioned within said cooling liquid in the path of said bubbles of said vaporized carrier.

13. A vapor control system as in claim 12 wherein said baffling device comprises a plurality of plates, each having a plurality of perforations, each of said plurality of plates being disposed horizontally within said cooling liquid, at least some of said plurality of perforations of one of said plurality of plates being vertically misaligned with at least some of said plurality of perforations of an adjacent one of said plurality of plates.

14. A vapor control system as in claim 12 wherein said baffling device comprises a stack consisting of a plurality of packing material.

15. A vapor control system for reducing vapor emissions in an electrographic system employing a developer having toner particles dispersed in a carrier liquid in which said carrier liquid is at least partially vaporized during operation of said liquid electrographic system creating vaporized carrier having a temperature, comprising:

vapor collection means for collecting at least some of said vaporized carrier from said electrographic system;

a container having a vapor inlet and a vapor outlet containing a non-aqueous cooling liquid, said cooling liquid having a temperature less than said temperature of said vaporized carrier but greater than zero degrees Centigrade; and flow means operatively coupled to said vapor collection means and to said vapor inlet of said container for delivering at least a portion of said vaporized carrier which has been collected within said vapor collection means to said cooling liquid in said container at a point below the surface of said cooling liquid;

wherein pressure drop is created through said cooling liquid between said vapor inlet and said vapor outlet of said container and wherein said flow means delivers said portion of said vaporized carrier to said cooling liquid with a pressure at least as great as ambient air pressure plus said pressure drop; and wherein said cooling liquid is immiscible with said liquid carrier and is immiscible with water;

whereby at least some of said vaporized carrier is condensed into said liquid carrier by said cooling liquid.

16. A vapor control system as in claim 15 wherein said carrier liquid is a hydrocarbon carrier liquid.

17. A vapor control system as in claim 16 further comprising a gas dispersion means for dispersing said vaporized carrier as said vaporized carrier enters said cooling liquid.

18. A vapor control system as in claim 17 wherein said gas dispersion means comprises a porous frit.

19. A vapor control system as in claim 18 wherein said porous frit has a median pore size of from at least 10μ to not more than 1,000μ.

20. A vapor control system as in claim 15 further comprising cooling means for cooling said cooling liquid.

21. A vapor control system as in claim 20 wherein said vaporized carrier also contains some water vapor and wherein at least a portion of said water vapor is condensed from said vaporized carrier along with at least some of said vaporized carrier to form water, said vapor control system further comprising liquid separating means associated with container for separating said water from said container.

22. A vapor control system as in claim 21 wherein said at least a portion of said condensed vaporized carrier is returned to said electrographic system for use in said developer.

23. A vapor control system as in claim 22 wherein said vapor collection means has an interior surface, said vapor control system further comprising returns means associated with said vapor collection means for returning any of said vaporized carrier collected by said vapor collection means which condenses on said interior surface of said vapor collection means to said electrographic system for use in said developer.

24. A vapor control system for reducing vapor emissions in an electrographic system employing a developer having toner particles dispersed in a carrier liquid in which said carrier liquid is at least partially vaporized during operation of said liquid electrographic system creating vaporized carrier having a temperature, comprising:

vapor collection means having an interior surface for collecting at least some of said vaporized carrier from said electrographic system;

a container having a vapor inlet and a vapor outlet containing a non-aqueous cooling liquid, said cooling liquid having a temperature less than said temperature of said vaporized carrier but greater than zero degrees Centigrade;

cooling means for cooling said cooling liquid;

flow means operatively coupled to said vapor collection means and to said vapor inlet of said container for delivering at least a portion of said vaporized carrier which has been collected within said vapor collection means to said cooling liquid in said container at a point below the surface of said cooling liquid; and returns means associated with said vapor collection means for returning any of said vaporized carrier collected by said vapor collection means which condenses on said interior surface of said vapor collection means to said electrographic system for use in said developer;

wherein pressure drop is created through said cooling liquid between said vapor inlet and said vapor outlet of said container and wherein said flow means delivers said portion of said vaporized carrier to said cooling liquid with a pressure at least as great as ambient air pressure plus said pressure drop;

wherein said vaporized carrier also contains some water vapor and wherein at least a portion of said water vapor is condensed from said vaporized carrier along with at least some of said vaporized carrier to form water, said vapor control system further comprising liquid separating means associated with container for separating said water from said container;

wherein said at least a portion of said condensed vaporized carrier is returned to said electrographic system for use in said developer;

wherein said vaporized carrier also contains some water vapor and wherein at least a portion of said water vapor is condensed from said vaporized carrier along with at least some of said vaporized carrier to form water, said vapor control system further comprising liquid separating means associated with container for separating said water from said container;

wherein said at least a portion of said condensed vaporized carrier is returned to said electrographic system for use in said developer; and wherein said vaporized carrier bubbles through said cooling liquid between said vapor inlet and said vapor outlet of said container with bubbles of said vaporized carrier traveling at a flow rate of not more than 50 standard liters per minute and wherein the average time of residence of said bubbles of said vaporized carrier within said cooling liquid is at least 0.1 second.

25. A vapor control system for reducing vapor emissions in an electrographic system employing a developer having toner particles dispersed in a carrier liquid in which said carrier liquid is at least partially vaporized during operation of said liquid electrographic system creating vaporized carrier having a temperature, comprising:

vapor collection means for collecting at least some of said vaporized carrier from said electro graphic system;

a container having a vapor inlet and a vapor outlet containing a cooling liquid, said cooling liquid having a temperature being less than said temperature of said vaporized carrier but greater than zero degrees Centigrade;

cooling means for cooling said cooling liquid;

flow means operatively coupled to said vapor collection means and to said vapor inlet of said container for creating an air pressure within said vapor collection means which is less than ambient air pressure and delivering at least a portion of said vaporized carrier which has been collected within said vapor collection means to said cooling liquid in said container at a point below the surface of said cooling liquid; and a baffling device positioned within said cooling liquid in the path of said bubbles of said vaporized carrier between said vapor inlet and said vapor outlet of said container;

wherein said vaporized carrier also contains some water vapor and wherein at least a portion of said water vapor is condensed from said vaporized carrier along with at least some of said vaporized carrier to form water, said vapor control system further comprising liquid separating means associated with container for separating said water from said container; and wherein said vapor collection means has an interior surface, said vapor control system further comprising return means associated with said vapor collection means for returning any of said vaporized carrier collected by said vapor collection means which condenses on said interior surface of said vapor collection means to said electrographic system for use in said developer.

26. An electrophotographic system, comprising:

a photoconductor having a surface;

charging means for charging said surface of said photoconductor;

discharge means for image-wise discharging said surface of said photoconductor;

a developer having toner particles dispersed in a carrier liquid in which said carrier liquid is at least partially vaporized during said liquid electrophotographic system creating vaporized carrier having a temperature;

vapor collection means for collecting at least some of said vaporized carrier from said electrophotographic system;

a container having a vapor inlet and a vapor outlet containing a non-aqueous cooling liquid, said cooling liquid having a temperature being less than said temperature of said vaporized carrier but greater than zero degrees Centigrade; and flow means operatively coupled to said vapor collection means and to said vapor inlet of said container for creating an air pressure within said vapor collection means which is less than ambient air pressure and delivering at least a portion of said vaporized carrier which has been collected within said vapor collection means to said cooling liquid in said container at a point below the surface of said cooling liquid;

wherein pressure drop is created through said cooling liquid between said vapor inlet and said vapor outlet of said container and wherein said flow means delivers said at least a portion of said vaporized carrier to said cooling liquid with a pressure at least as great as ambient air pressure plus said pressure drop;

wherein said carrier liquid is a hydrocarbon carrier liquid; and wherein said cooling liquid is miscible with said liquid carrier and is immiscible with water;

whereby at least some of said vaporized carrier is condensed into said liquid carrier by said cooling liquid.

27. A vapor control system as in claim 26 further comprising a gas dispersion means for dispersing said vaporized carrier as said vaporized carrier enters said cooling liquid.

28. A vapor control system as in claim 27 wherein said gas dispersion means comprises a porous frit.

29. A vapor control system as in claim 28 wherein said porous frit has a median pore size of from at least 10μ to not more than 1,000μ.

30. A vapor control system as in claim 26 wherein said vaporized carrier bubbles through said cooling liquid between said vapor inlet and said vapor outlet of said container with bubbles of said vaporized carrier traveling at a flow rate of not more than 50 standard liters per minute and wherein the average time of residence of said bubbles of said vaporized carrier within said cooling liquid is at least 0.1 second.

31. A vapor control system as in claim 26 further comprising cooling means for cooling said cooling liquid.

* * * * *